United States Patent [19]

Eisele

[11] Patent Number: 4,649,681

[45] Date of Patent: Mar. 17, 1987

[54] MULTI-PANELED INSULATIVE COVERING

[76] Inventor: Wayne Eisele, P.O. Box 825, Scottsbluff, Nebr. 69361

[21] Appl. No.: 859,321

[22] Filed: May 5, 1986

[51] Int. Cl.[4] ..... E06B 3/26

[52] U.S. Cl. ..... 52/202; 52/309.15; 52/788; 52/790

[58] Field of Search ..... 52/202, 203, 309.15, 52/788, 790; 428/34

[56] References Cited

U.S. PATENT DOCUMENTS

| | | | |
|---|---|---|---|
| 1,957,279 | 5/1934 | Linke | 126/428 X |
| 2,046,362 | 7/1936 | Baldwin | 52/203 |
| 2,094,294 | 9/1937 | Garritsen | 52/788 X |
| 2,257,948 | 10/1941 | Green | 52/790 X |
| 2,288,465 | 6/1942 | Knudsen | 126/428 X |
| 2,518,969 | 8/1950 | Woodard | 52/202 X |
| 3,024,880 | 3/1962 | Burmerster | 52/788 X |
| 3,308,593 | 3/1967 | Smith | 52/790 X |
| 4,068,428 | 1/1978 | Peterson, III | 49/61 X |
| 4,081,934 | 4/1978 | Frang | 52/171 |
| 4,098,035 | 7/1978 | Bassler | 52/202 X |
| 4,149,348 | 4/1979 | Pyzewski | 52/790 X |
| 4,193,235 | 3/1980 | Cucchiara | 52/202 |
| 4,358,490 | 11/1982 | Nagai | 428/34 |
| 4,520,611 | 6/1985 | Shingu et al. | 52/790 X |
| 4,527,548 | 7/1985 | Gustafson | 126/428 X |

FOREIGN PATENT DOCUMENTS

| | | | |
|---|---|---|---|
| 801435 | 12/1968 | Canada | 52/788 |
| 878093 | 6/1953 | Fed. Rep. of Germany | 52/788 |
| 1132070 | 10/1968 | United Kingdom | 52/309.13 |

*Primary Examiner*—Alfred C. Perham

*Attorney, Agent, or Firm*—Norman B. Rainer

[57] ABSTRACT

A thermally insulative covering device is provided which can be removably associated with the interior side of windows or sliding doors of a building. The device is fabricated as a frame which tautly holds four sheets of a transparent film in a manner to form three successive stagnant air spaces. A continuous border strip of a resilient material causes the device to make a snug friction fit with a window or door and causes the space between the device and the window or door to be a fourth stagnant air space.

8 Claims, 4 Drawing Figures

MULTI-PANELED INSULATIVE COVERING

BACKGROUND OF THE INVENTION

This invention relates to the prevention of heat loss through closed window and patio door openings of residential buildings, and more particularly concerns a rectangular multi-paneled assembly adapted to be inserted into the enclosure frames of such windows and doors.

The prior art includes many forms of coverings adapted for attachment to an existing primary window frame or sliding-type patio door, preferably from the interior side of the window or door. Among the disclosed types of coverings are auxiliary windows comprised of thin sheet plastic glazing held tautly by frames adapted to fit within a primary window frame. Typical examples of such auxiliary windows are disclosed in U.S. Pat. No. 4,193,235 to Cucchiara and U.S. Pat. No. 4,068,428 to Peterson. Such devices, however, utilize frame structures of considerable complexity and expense, and which are not easily installed into and removed from the primary window frame. Some of such devices require that modifications be made in the primary window or frame to facilitate installation.

The auxiliary window coverings are generally intended primarily to act in association with the primary window to create a stagnant air space which serves as a barrier to heat transfer through the primary window. The auxiliary window covering generally does not, in and of itself, provide thermal insulation. Furthermore, unless the auxiliary window forms a tight seal with the primary window, the insulative effect of the stagnant air space will be lost or greatly diminished.

It is accordingly an object of the present invention to provide a thermally insulative covering fabricated of thin sheet plastic material.

It is another object of this invention to provide a covering as in the foregoing object having a frame which facilitates easy association and dis-association with the interior surface of a window or door without requisite modification thereof.

It is a further object of the present invention to provide a covering of the aforesaid nature which causes a stagnant air space to be formed adjacent the interior surface of a window or door.

It is still another object of this invention to provide a covering of the aforesaid nature of rugged and durable construction amenable to low cost manufacture.

These objects and other objects and advantages of the invention will be apparent from the following description.

SUMMARY OF THE INVENTION

The above and other beneficial objects and advantages are accomplished in accordance with the present invention by thermally insulative covering device comprising:

(a) a frame having opposed parallel horizontal side members and opposed parallel vertical side members, said side members being joined in a rectangular contour, each side member being comprised of a center strip and two outer strips, said strips having flat abutment surfaces and arranged in stacked configuration forming a smooth flat outer edge, (b) support braces extending perpendicularly between said horizontal and vertical side members and comprised of center and outer strips in stacked configuration and in coplanar disposition with the corresponding strips of the side members, (c) transparent plastic sheet material attached to said frame as two outer panels and two inner panels, said panels being disposed in tautly held layered configuration, the outer panels being attached to the exterior abutment surfaces of the outer strips, and the inner panels being held in sandwiched relationship between the abutment surfaces of the center and outer strips of the side members and support braces, whereby the panels are maintained in separated relationship, and (d) a continuous resilient border material uniformly applied to the outer edge of said frame.

In preferred embodiments of the invention, the strips which comprise the side members and support braces are fabricated of wood, typically of ¼" thickness and 1½" width or wider. The transparent film may be fabricated of plasticized polyvinylchloride, polypropylene, polycarbonate, polyester, polyacrylic, or other equivalent thermoplastic polymer having good resistance to sunlight and thermal cycling. The film may be attached to the frame by stapling, taping or adhesives, and the same attaching means may be used to consolidate the strips which form the side members of the frame. The support braces may be disposed in various rectangular patterns within the frame, and may be specially placed so as to match the cross-members of the existing primary window or door with which the covering will be associated. The resilient border material is preferably a closed cell foam of a resilient polymer.

By virtue of the aforesaid manner of construction of the thermally insulative covering device of this invention, three successively disposed stagnant air spaces are formed and serve as barriers toward heat transfer with respect to the primary window or door. The resilient border associated with the frame enables the covering device to form a friction fit with the casement structure of the window or door, thereby facilitating installation and removal of the device, and further forming still another stagnant air layer in conjunction with the window or door.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

For clarity of description, the expressions "interior", "exterior" and terms equivalent thereto will have reference to the geometric center of the covering device of this invention.

DESCRIPTION OF THE PREFERRED EMBODIMENTS

Figure 1:
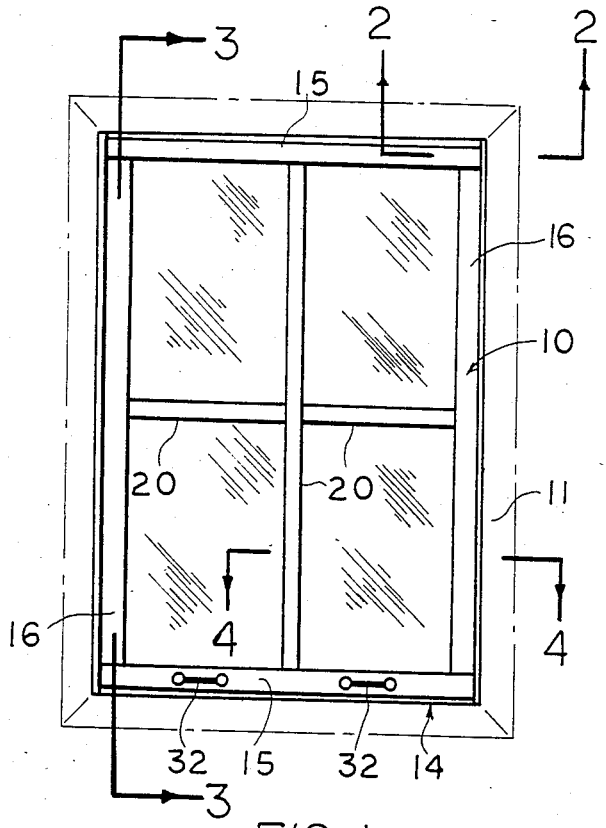
FIG. 1 is a front view of an embodiment of the covering device of the present invention shown in association with a window.
Figure 2:
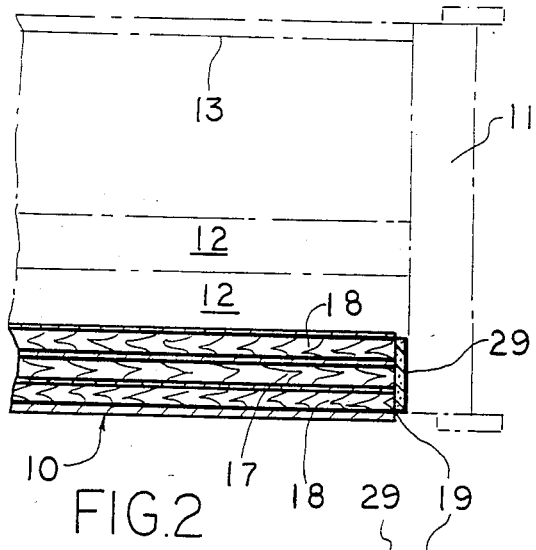
FIG. 2 is an enlarged fragmentary sectional view taken along the line 2—2 of FIG. 1.

Referring to FIGS. 1 and 2, an embodiment of a covering device 10 of this invention is shown mounted within an existing window frame casing 11 which holds vertically slidable window sash 12 and outside storm window 13.

The covering device is comprised of frame 14 having opposed parallel horizontal side members 15 and opposed parallel vertical side members 16, said side members being joined in a rectangular contour. Each side member is comprised of a center strip 17 and two outer strips 18 in stacked configuration with respect to flat abutment surfaces 30. In the illustrated embodiment, the strips are of wood, having a uniform thickness of ¼" and a width of 1½". In the case of insulative coverings of this invention intended for use on patio sliding doors, the strips of wood may have a width up to 2½ inches. The combined three strips of each side member form a smooth flat and straight outer edge 19. The strips of the horizontal side members are joined at their extremities to the corresponding strips of the vertical side members by conventional joining techniques which will not impair the flat abutment surface configuration of the strips.

Support braces 20, disposed within the interior region bounded by frame 14, extend perpendicularly between said horizontal and vertical side members. Each brace is constructed of center strip 21 and outer strips 22, said strips having flat abutment surfaces 23 and disposed in stacked arrangement. The center strips of the braces are of equal thickness of the corresponding center strips of the side members and in coplanar disposition therewith, and outer strips 22 are likewise of equal thickness to the corresponding outer strips 18 of the side members, and in coplanar disposition therewith. The strips of the support braces and side members are perpendicularly interconnected by conventional techniques which do not intrude upon the abutment surfaces. The center strips of the braces are mortised into the corresponding center strips of the side members at their sites of intersection. Such construction provides a strengthening effect to the overall structure.

Figure 4:
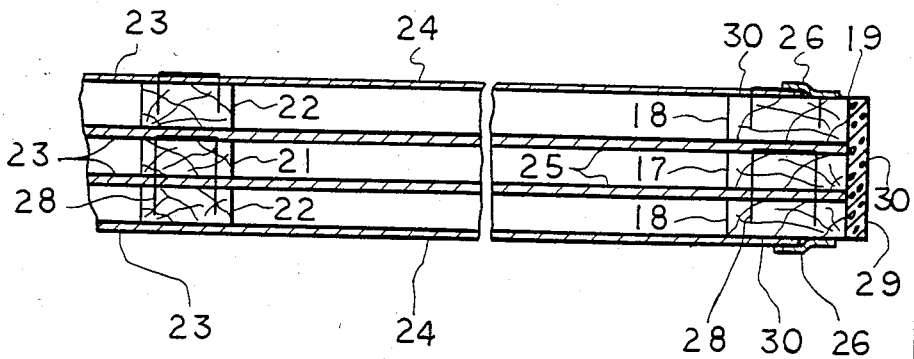
FIG. 4 is an enlarged fragmentary sectional view taken along the line 4—4 of FIG. 1.

As best shown in FIG. 4, four panels of transparent plastic sheet material are associated with the frame as paired outer panels 24 and paired inner panels 25, said panels being disposed in tautly held layered configuration. The outer panels are attached to the exterior abutment surfaces of the outer strips by staples 28 and adhesive tape 26 which further provides an air-tight seal between the outer panel and the frame. Adhesives may be employed instead of the tape or in conjunction with the tape. The inner panels are held in sandwiched relationship between the abutment surfaces of the center and outer strips of the side members and support braces. In such relationship, the panels are maintained a fixed distance apart, and create three layers of stagnant air space. The panels may, for example, be plasticized polyvinylchloride having a thickness in the range of 3 to 10 mils. The various wooden strips are interengaged by staples 28 having leg lengths greater than the thickness of the strips. The panels and strips are thereby consolidated to a self-supporting structure.

Figure 3:
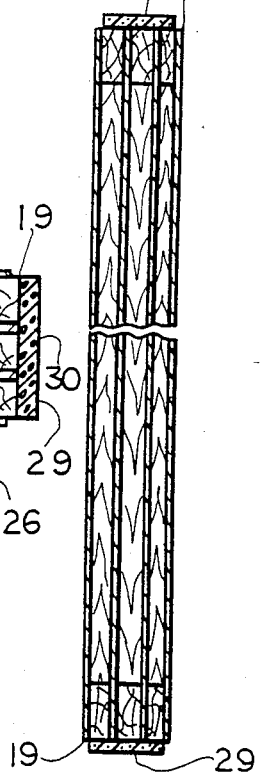
FIG. 3 is an enlarged fragmentary sectional view taken along the line 3—3 of FIG. 1.

As shown in FIGS. 2, 3, and 4, a continuous resilient border material 29 is adhered to the flat outer edge of the side members. Said border material is preferably comprised of a uniform strip of a closed cell foam of a resilient polymer such as polyurethane, polyethylene, or neoprene. The thickness of the border material is such that, in conjunction with the dimensions of the frame, the covering device is caused to make a snug-fitting friction-holding fit with the inwardly directed surfaces of window frame casing 11 when the device is pushed into said casing. Handles 32 may be attached to the frame to facilitate pulling removal from engagement with the window casing.

By way of similar principles of construction, the covering device may be adapted to use with horizontally sliding patio-type doors.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A thermally insulative covering device comprising:

(a) a frame having opposed parallel horizontal side members and opposed parallel vertical side members, said side members being joined in a rectangular contour, thereby defining an interior region, each side member being comprised of a center strip and two outer strips, said strips having flat abutment surfaces and arranged in stacked configuration forming a smooth flat outer edge, (b) support braces within said interior region extending perpendicularly between said horizontal and vertical side members and comprised of center and outer strips in stacked configuration and in coplanar disposition with the corresponding strips of the side members, (c) transparent plastic sheet material attached to said frame as two outer panels and two inner panels, said panels being disposed in tautly held layered configuration to cover the entire interior region while forming three successively disposed stagnant air spaces, the outer panels being attached to the exterior abutment surfaces of the outer strips, and the inner panels being held in sandwiched relationship between the abutment surfaces of the center and outer strips of the side members and support braces, whereby the panels are maintained in separated relationship, and (d) a continuous resilient border material uniformly applied to the flat outer edge of said frame.

2. The covering device of claim 1 wherein the strips which comprise said side members and support braces are fabricated of wood.

3. The covering device of claim 2 wherein said strips have a thickness of about ¼ inch.

4. The covering device of claim 3 wherein the width of said strips is between about 1 and 2½ inches.

5. The covering device of claim 1 wherein said panels are attached to said frame and support braces by staples which serve additionally to consolidate the strips of said frame and support braces.

6. The covering device of claim 5 wherein said outer panels are further attached to said frames by means of adhesive tape which creates an air-tight seal between the frame and the edges of said panels.

7. The covering device of claim 6 wherein said resilient border material is a closed cell foam of a resilient polymer.

8. The covering device of claim 6 having handles mounted to said frame to facilitate pulling removal of the device from association with a window or door of a building.

* * * * *